US011834293B1

(12) United States Patent
Martelli et al.

(10) Patent No.: US 11,834,293 B1
(45) Date of Patent: Dec. 5, 2023

(54) BOBBIN LOADER APPARATUS AND METHOD

(71) Applicants: John D. Martelli, Pensacola, FL (US); Chris Beaty, Post Falls, ID (US)

(72) Inventors: John D. Martelli, Pensacola, FL (US); Chris Beaty, Post Falls, ID (US)

( * ) Notice: Subject to any disclaimer, the term of this patent is extended or adjusted under 35 U.S.C. 154(b) by 296 days.

(21) Appl. No.: 17/317,336

(22) Filed: May 11, 2021

(51) Int. Cl.

| | |
|---|---|
| ***B65H 54/28*** | (2006.01) |
| ***B65H 54/18*** | (2006.01) |
| ***B65H 54/44*** | (2006.01) |
| ***B65H 59/12*** | (2006.01) |
| ***B65H 59/38*** | (2006.01) |
| ***B65H 54/12*** | (2006.01) |

(52) U.S. Cl.
CPC ..... *B65H 54/2869* (2013.01); *B65H 54/12* (2013.01); *B65H 54/18* (2013.01); *B65H 54/2812* (2013.01); *B65H 54/44* (2013.01); *B65H 59/12* (2013.01); *B65H 59/385* (2013.01); *B65H 59/387* (2013.01)

(58) Field of Classification Search
CPC .... B65H 54/12; B65H 54/18; B65H 54/2812; B65H 54/2869; B65H 54/44; B65H 59/12; B65H 59/385; B65H 59/387
See application file for complete search history.

(56) References Cited

U.S. PATENT DOCUMENTS

| | | | | |
|---|---|---|---|---|
| 5,865,394 A * | 2/1999 | Giese | D05B 59/00 242/484.8 |
| 8,936,209 B1 * | 1/2015 | Knierim | H01F 41/048 242/412.1 |
| 2015/0217966 A1 * | 8/2015 | Ruff | B65H 54/74 242/474.4 |
| 2019/0218055 A1 * | 7/2019 | Ruff | B65H 54/106 |

* cited by examiner

*Primary Examiner* — William E Dondero
(74) *Attorney, Agent, or Firm* — J. Nevin Shaffer, Jr.

(57) ABSTRACT

A bobbin loader apparatus and method includes a bobbin connected with a first motor. A thread holder is connected with a second motor where the thread holder is configured to hold thread. A thread guide is connected with a third motor where the thread guide directs thread from the thread holder to the bobbin. A motor controller is connected with the first motor, the second motor and the third motor where the motor controller operates the first motor to turn the bobbin in a first direction and the second motor to turn the thread holder in a second direction such that tension is applied to the thread as thread is added to the bobbin.

20 Claims, 4 Drawing Sheets

BOBBIN LOADER APPARATUS AND METHOD

FIELD OF THE INVENTION

This invention relates to a bobbin loader device. In particular, in accordance with one embodiment, the invention relates to a bobbin loader apparatus including a bobbin connected with a first motor. A thread holder is connected with a second motor where the thread holder is configured to hold thread. A thread guide is connected with a third motor where the thread guide directs thread from the thread holder to the bobbin. A motor controller is connected with the first motor, the second motor and the third motor where the motor controller operates the first motor to turn the bobbin in a first direction and the second motor to turn the thread holder in a second direction such that tension is applied to the thread as thread is added to the bobbin.

BACKGROUND OF THE INVENTION

A problem exists in the sewing art with regard to adding thread to a bobbin, for example only and not by limitation. The state of the art is a manually operated spring tension device that puts tension on a thread as the thread is added to the bobbin. Several problems exist with this prior art system. To begin with, it is cumbersome to attach and difficult to adjust accurately. As a result, typically, thread is added to a bobbin either too loosely or too tightly which results in tangles on the bobbin or thread breakage.

Additionally, springs used in the prior art device are subject to degeneration over time and expand and contract in reaction to changes in temperature and humidity such that the tension set by a user changes.

Further, thread added by prior art systems overlap as added which reduces the amount of thread capable of being added to a bobbin and increases the chances of tangles and breakage as thread is removed from the bobbin when in use.

Still further, bobbins come in a variety of sizes such that adding thread to different bobbins requires tedious, inexact, readjustment of the prior art bobbin loading devices.

Thus, there is a need in the art for bobbin loading device that is easy to use, easy to adjust from one bobbin to another and that loads thread on a bobbin without overlapping the thread.

It therefore is an object of this invention to provide an easy to use economical automated bobbin loader that allows the user to add thread to any size bobbin, under adjustable tension, without overlap.

It is a further object of the invention to provide a bobbin loader that allows the user to determine exactly how much thread a bobbin can accommodate and how much thread is added to each bobbin no matter the size of the bobbin.

SUMMARY OF THE INVENTION

Accordingly, the bobbin loader apparatus and method of the present invention, according to one embodiment, includes a bobbin connected with a first motor, where the bobbin has a connecting shaft connecting a first end and a second end and where the connecting shaft has a length and an outside diameter and the first end and the second end are separated by a width approximately equal to the length of the connecting shaft. A thread holder is connected with a second motor where the thread holder is configured to hold thread. A thread guide is connected with a third motor where the thread guide directs thread from the thread holder to the bobbin. A motor controller is connected with the first motor, the second motor and the third motor where the motor controller operates the first motor to turn the bobbin in a first direction and the second motor to turn the thread holder in a second direction such that tension is applied to the thread as thread is added to the bobbin.

All terms used herein are given their common meaning so that "bobbin" identifies and describes a device used in sewing that contains thread wrapped around a central axis with two circular end pieces. Bobbins come in a variety of sizes, holding more or less thread and are well known in the art. Certainly, the present invention is not limited to bobbins and thread but is applicable in any endeavor where material is moved from one device or location and wrapped onto another device. Optic cables, electric wires, fishing line, for example, are manufactured in length and distributed for use wrapped on carriers. The carriers have a central axis and end pieces, for example, similar to bobbins.

"Motor controller" describes and identifies a device for manipulating a motor including on, off and speed variations. Further as the term is used herein, motor controller includes computing devices for manipulating data as is known in the art and may include wireless control, for example only and not by limitation.

"Tension" describes a measure of resistance to movement as one end of a thread is pulled in one direction while the opposite end of the thread is pulled in the opposite direction, for example only and not by limitation.

In another aspect, the motor controller operates the third motor such that the thread guide moves back and forth the length of the connecting shaft as thread is added to the bobbin.

In one aspect, the motor controller, upon receiving input data including the width of the bobbin, the length of the connecting shaft, the outside diameter of the connecting shaft and a diameter of a thread to be added to a bobbin, operates the third motor such that the thread guide moves back and forth the length of the connecting shaft such that thread is deposited without overlap.

In one aspect, the motor controller, upon receiving input data including bobbin dimensions and thread dimensions, determines the amount of thread a bobbin will hold.

In another aspect, the motor controller determines the amount of thread added to a bobbin.

In one aspect, the thread guide includes a thread channel guide into which thread enters and from which thread exits such that thread is aligned with the thread channel guide as it exits the thread channel guide.

In a further aspect, the thread channel guide is free to move such that as current layers of thread are added to a bobbin, the thread channel guide is aligned with the level of the current layer of thread.

In one aspect, the thread guide includes a thread gate where the thread gate includes a pair of horizontal contacts between which thread from said thread holder is directed.

In one aspect, the thread guide includes a pair of vertical contacts between which thread is directed in an "S" pattern.

According to another embodiment a bobbin loader apparatus includes a bobbin removably connected with a first motor, where the bobbin has a connecting shaft connecting a first end and a second end and where the connecting shaft has a length and an outside diameter and the first end and the second end are separated by a width approximately equal to the length of the connecting shaft. A thread holder is connected with a second motor where the thread holder is configured to hold thread. A thread guide is connected with a third motor where the thread guide directs thread from the thread holder to the bobbin. A motor controller is connected with the first motor, the second motor and the third motor where the motor controller operates the first motor to turn the bobbin in a first direction and the second motor to turn the thread holder in a second direction such that tension is applied to the thread as thread is added to the bobbin and where the motor controller operates the third motor such that the thread guide moves back and forth the length of the connecting shaft as thread is added to the bobbin and where the motor controller, upon receiving input data including bobbin dimensions and thread dimensions, determines the amount of thread a bobbin will hold.

In one aspect, the motor controller, upon receiving input data including the width of the bobbin, the length of the connecting shaft, the outside diameter of the connecting shaft and a diameter of a thread to be added to a bobbin, operates the third motor such that the thread guide moves back and forth the length of the connecting shaft such that thread is deposited without overlap.

In one aspect, the motor controller determines the amount of thread added to a bobbin.

In another aspect, the thread guide includes a thread channel guide, including a vertical thread channel and a horizontal thread channel, into which thread enters and from which thread exits such that thread is aligned with the thread channel guide as it exits the thread channel guide.

In one aspect, the thread channel guide is free to move such that as current layers of thread are added to a bobbin, the thread channel guide is aligned with the level of the current layer of thread.

In one aspect, the thread guide includes a thread gate where the thread gate includes a pair of horizontal contacts between which thread from said thread holder is directed.

In one aspect, the thread guide further includes a pair of vertical contacts between which thread is directed in an "S" pattern.

In a further aspect, the thread guide includes:

a. a thread channel guide into which thread enters and from which thread exits such that thread is aligned with the thread channel guide as it exits the thread channel guide and where the thread channel guide is free to move such that as current layers of thread are added to a bobbin, the thread channel guide is aligned with the level of the current layer of thread;

b. a thread gate where the thread gate includes a pair of horizontal contacts between which thread from said thread holder is directed; and c. a pair of vertical contacts between which thread is directed in an "S" pattern.

According to another embodiment, a bobbin loader method consists of:

a. providing a bobbin connected with a first motor, where the bobbin has a connecting shaft connecting a first end and a second end and where the connecting shaft has a length and an outside diameter and the first end and the second end are separated by a width approximately equal to the length of the connecting shaft; a thread holder connected with a second motor where the thread holder is configured to hold thread; a thread guide connected with a third motor where the thread guide directs thread from the thread holder to the bobbin; and a motor controller connected with the first motor, the second motor and the third motor where the motor controller operates the first motor to turn the bobbin in one direction and the second motor to turn the thread holder in a second direction such that tension is applied to the thread as thread is added to the bobbin; and b. adding thread to the thread holder, directing thread to the thread guide and from the thread guide to the bobbin.

In one aspect, the motor controller operates the third motor such that the thread guide moves back and forth the length of the connecting shaft as thread is added to the bobbin and where the motor controller, upon receiving input data including bobbin dimensions and thread dimensions, determines the amount of thread a bobbin will hold and where the motor controller, upon receiving input data including the width of the bobbin, the length of the connecting shaft, the outside diameter of the connecting shaft and a diameter of a thread to be added to a bobbin, operates the third motor such that the thread guide moves back and forth along the length of the connecting shaft such that thread is deposited without overlap.

DESCRIPTION OF THE DRAWINGS

Other objects, features and advantages of the present invention will become more fully apparent from the following detailed description of the preferred embodiment, the appended claims and the accompanying drawings in which:

DETAILED DESCRIPTION OF THE INVENTION

Figure 1:
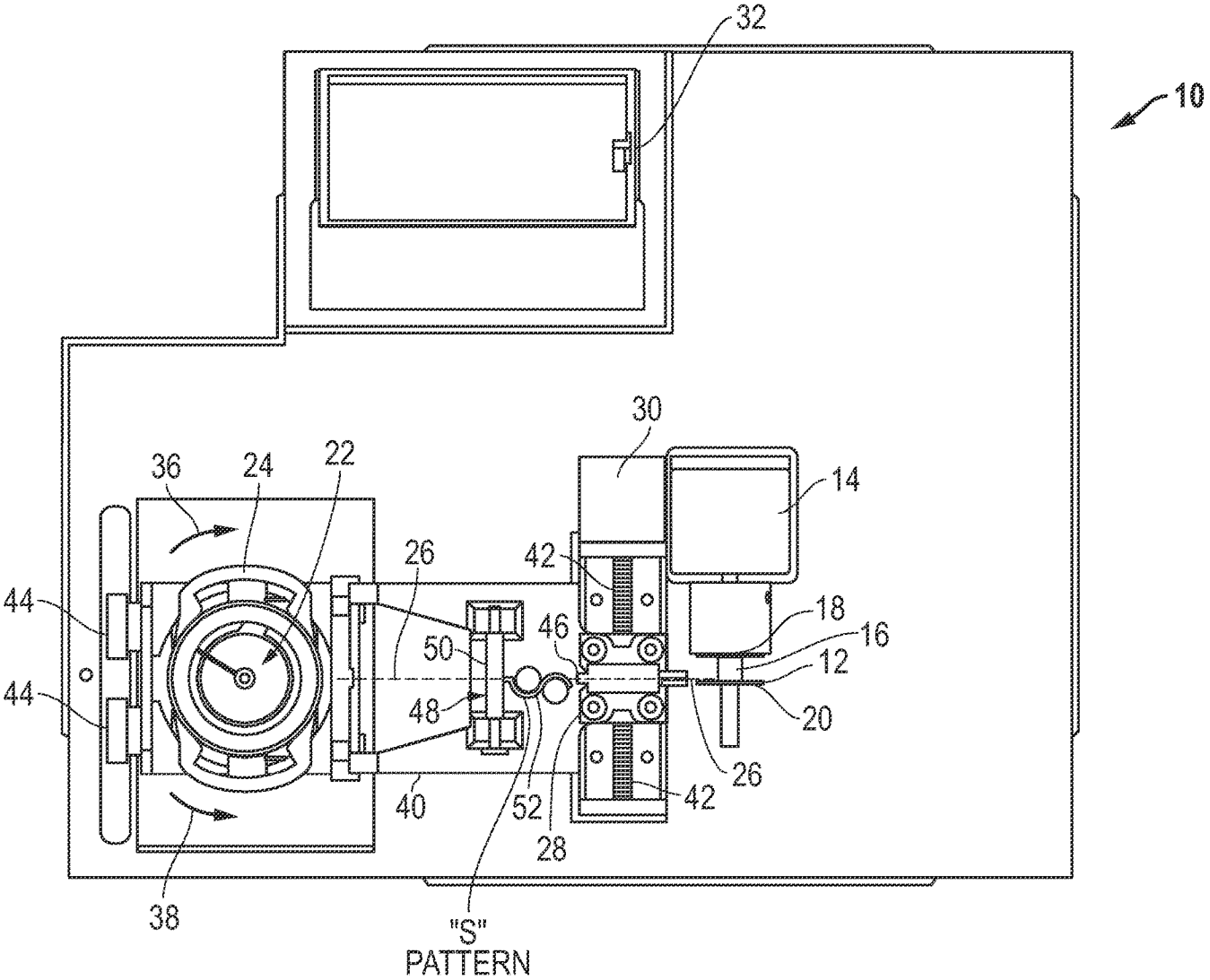
FIG. 1 is a top view of the bobbin loader of the present invention shown connected to an object.
Figure 2:
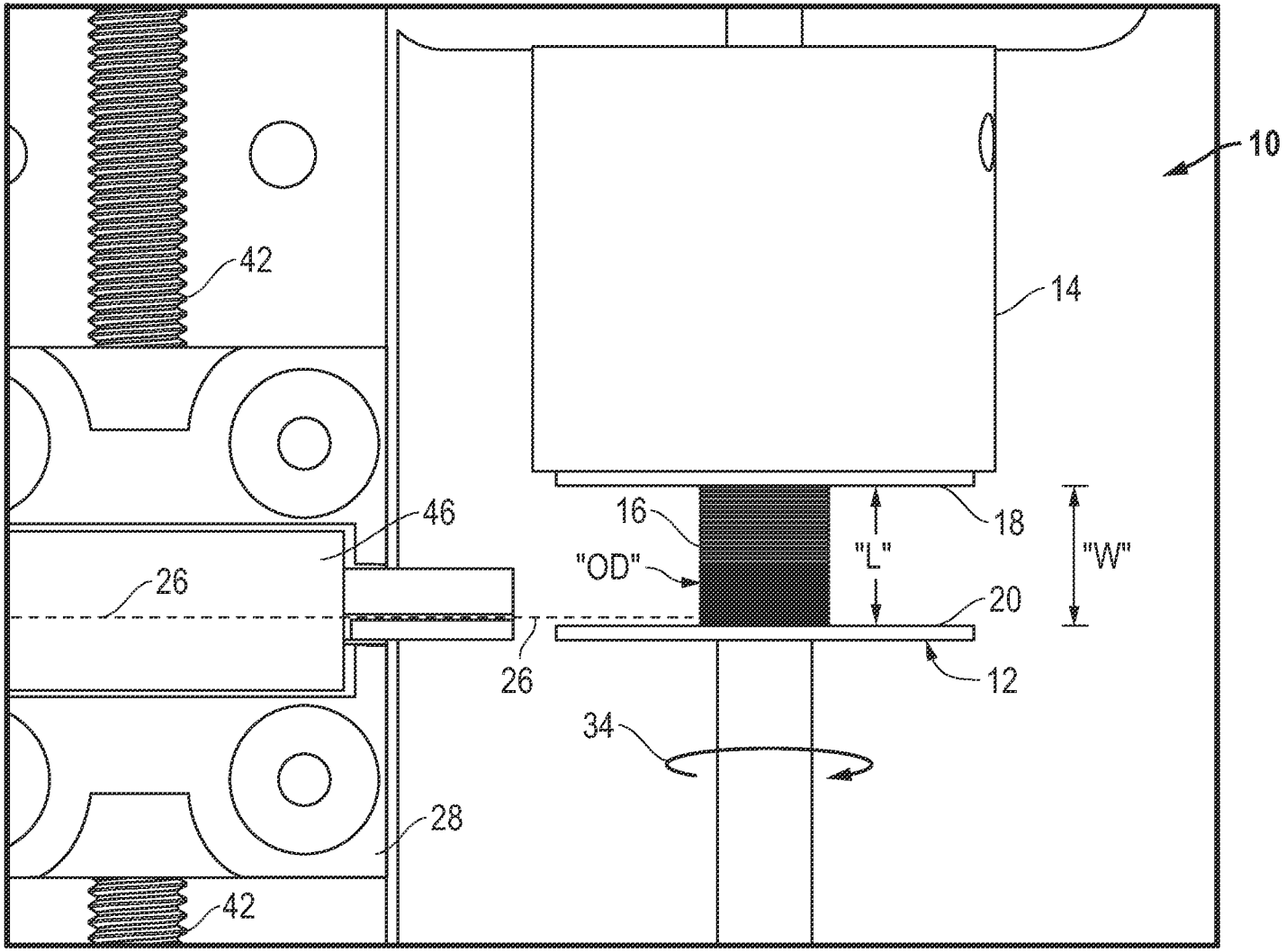
FIG. 2 is an expanded view of the invention of FIG. 1 showing the thread guide and bobbin.
Figure 3:
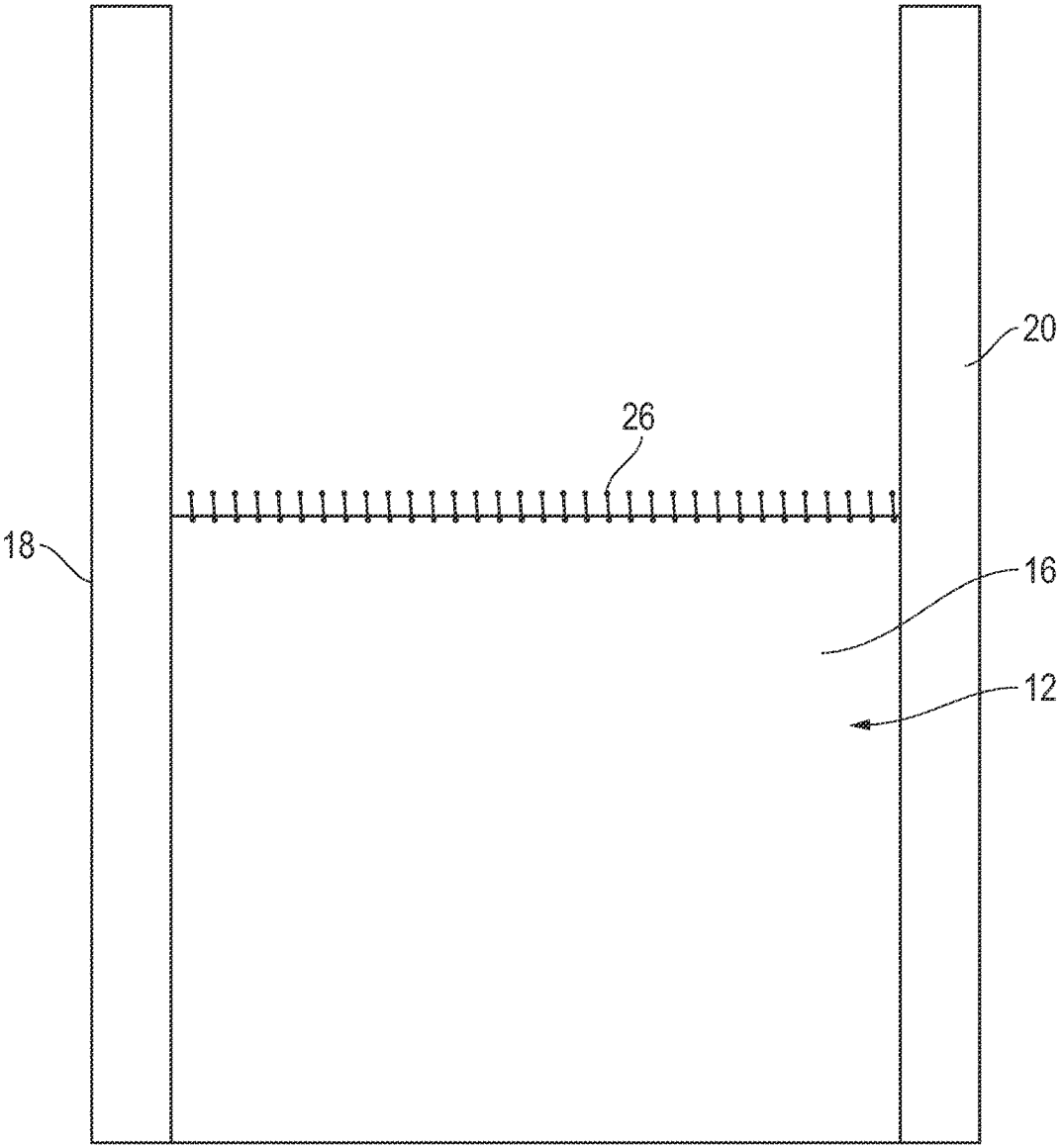
FIG. 3 is an expanded side view of the bobbin of the invention of FIG. 1 showing the build up of thread on a bobbin without overlap.

Before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the invention be regarded as including equivalent constructions to those described herein insofar as they do not depart from the spirit and scope of the present invention.

For example, the specific sequence of the described process may be altered so that certain processes are conducted in parallel or independent, with other processes, to the extent that the processes are not dependent upon each other. Thus, the specific order of steps described herein is not to be considered implying a specific sequence of steps to perform the process. In alternative embodiments, one or more process steps may be implemented by a user assisted process and/or manually. Other alterations or modifications of the above processes are also contemplated.

In addition, features illustrated or described as part of one embodiment can be used on other embodiments to yield a still further embodiment. Additionally, certain features may be interchanged with similar devices or features not mentioned yet which perform the same or similar functions. It is therefore intended that such modifications and variations are included within the totality of the present invention.

It should also be noted that a plurality of hardware and software devices, as well as a plurality of different structural components, may be utilized to implement the invention. Furthermore, and as described in subsequent paragraphs, the specific configurations illustrated in the drawings are intended to exemplify embodiments of the invention and that other alternative configurations are possible.

A preferred embodiment of the present invention is illustrated by way of example in FIGS. 1-4. With specific reference to FIGS. 1 and 2, bobbin loader apparatus 10 includes a bobbin 12 removably connected with a first motor 14, where the bobbin 12 has a connecting shaft 16 connecting a first end 18 and a second end 20 and where the connecting shaft 16 has a length "L" and an outside diameter "OD" (as more clearly shown in FIG. 2). The first end 18 and the second end 20 are separated by a width 'W' approximately equal to the length "L" of the connecting shaft 16.

A thread holder 22 is connected with a second motor 24 where the thread holder 22 is configured to hold thread 26. A thread guide 28 is connected with a third motor 30 where the thread guide 28 directs thread 26 from the thread holder 22 to the bobbin 12.

A motor controller 32 is connected with the first motor 14, the second motor 24 and the third motor 30. Motor controller 32 operates the first motor 14 to turn the bobbin in a first direction (see direction arrow 34 on FIG. 2). At the same time, motor controller 32 operates the second motor 24 to turn the thread holder 22 in a second direction (see direction arrow 36 on FIG. 1) such that tension is applied to the thread 26 as thread 26 is added to the bobbin 12. Without second motor 24, thread 26 is simply pulled off of thread holder 22, causing thread holder 22 to rotate in the direction of direction arrow 38 (see FIG. 1) as it is unwrapped without resistance as first motor 14 rotates bobbin 12 and thread is added to bobbin 12 in an uncontrolled manner. According to the present invention however, motor controller 32 operates second motor 24 to turn thread holder 22 in a second direction, in the direction of direction arrow 36 for example. This results in tension added to thread 26 as it is added to bobbin 12. Motor controller 32 can easily increase or decrease the tension on thread 26 by increasing or decreasing the speed of operation of second motor 24. Preferably, second motor 24 is an analog, programable, DC motor that allows it to turn or rotate against the direction of rotation without damage. That is, bobbin 12 pulls thread 26 in one direction and causes the thread holder 22 to turn. Second motor 24 allows the thread holder 22 to rotate in response but at the same time turns the thread holder 22 in the opposite direction thus adding tension.

Additionally, motor controller 32 is connected with and operates the third motor 30 such that the thread guide 28 moves back and forth the length "L" of the connecting shaft 16 as thread 26 is added to the bobbin 12. As shown in FIG. 1, thread guide 28 and thread holder 22, as well as other elements of thread guide 28 in between, as will be described more fully hereafter, are connected to platform 40, for example only. Thread guide 28 is connected with third motor 30, as with a screw drive shaft 42, for example only. Turning screw shaft 42 moves the thread guide 28 such that thread guide 28 can be moved back and forth as thread 26 is added to bobbin 12. Because thread holder 22 is connected with the same platform 40 as thread guide 28, thread holder 22 never moves out of alignment with thread guide 28. Wheels 44 on platform 40 provide easy movement of platform 40.

It should be understood that motor controller 32 is a computing system as known for receiving, processing, manipulating and sending data and instructions to and from connected devices. As such, motor controller 32, upon receiving user input data including bobbin dimensions and thread dimensions, determines the amount of thread 26 a bobbin 12 will hold. This is a significant improvement over the art that relied mostly upon visual observations as thread 26 was added. In another aspect, the motor controller 32 determines the amount of thread 26 added to a bobbin 12.

Importantly, motor controller 32, upon receiving input data including the width "W" of the bobbin 12, the length "L" of the connecting shaft 16, the outside diameter "OD" of the connecting shaft 16 and a diameter of a thread 26 to be added to a bobbin 12, operates the third motor 30 such that the thread guide 28 moves back and forth the length "L" of the connecting shaft 16 such that thread is deposited on bobbin 12 without overlap. (See FIG. 3) This enables a user to add more thread 26 to a bobbin 12 than with prior art systems that overlapped thread 26 as it was loaded. Also, the present invention results in loaded bobbins 12 that are less likely to cause thread 26 to snarl or tangle as it is pulled from the bobbin 12.

In one aspect of the bobbin loader apparatus 10 (see FIGS. 2 and 4), thread guide 28 includes a thread channel guide 46 into which thread 26 enters and from which thread 26 exits such that thread 26 is aligned with the thread channel guide 46 as it exits the thread channel guide 26. That is, the structure of thread channel guide 46 ensures that the thread is properly aligned with bobbin 12 just as thread 26 is added to bobbin 12.

In a further aspect, the thread channel guide 46 is free to move such that as current layers of thread 26 are added to a bobbin 12, the thread channel guide 46, and the thread 26 leaving thread channel guide 46, are aligned with the level of the current layer of thread 26 on a bobbin. That is, as the thread 26 loaded onto a bobbin 12 increases, thread channel guide 46 is lifted by the thread 26 to the same level as the highest level being added. This reduces undue stress on thread 26 and enables an accurate and untangled loading.

Figure 4:
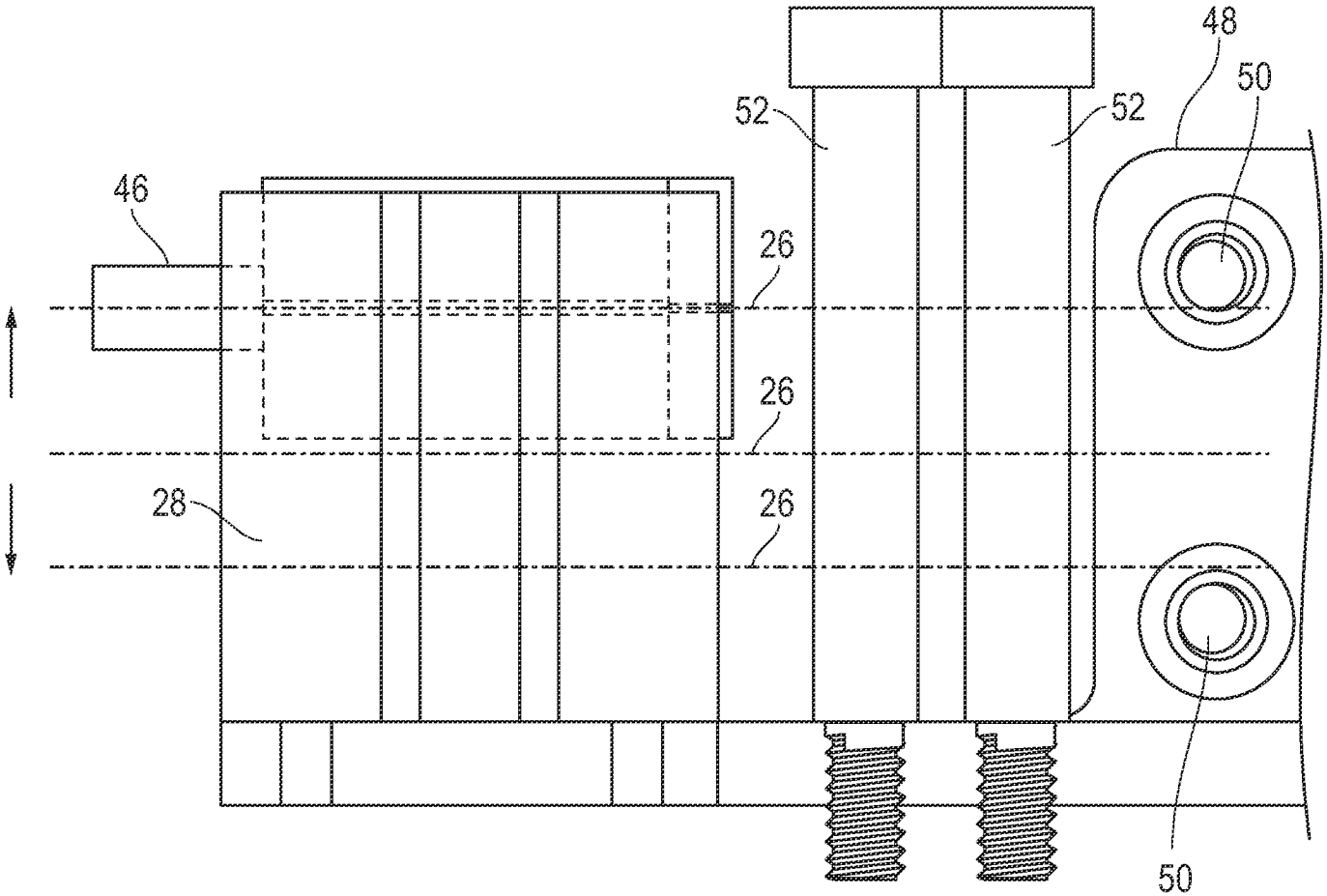
FIG. 4 is an expanded side view of thread gate, vertical gate and horizontal gate of the invention of FIG. 1.

In one aspect, the thread guide 28 includes a thread gate 48 where the thread gate 48 includes a pair of horizontal contacts 50 between which thread 26 from said thread holder 22 is directed. Still further, in one aspect, the thread guide 28 includes a pair of vertical contacts 52 between which thread 26 is directed in an "S" pattern as shown in FIG. 1. FIG. 4 is a side view of each of the elements of thread guide 28 in this configuration. The structure of thread guide 28 is, again, designed to position thread 26 in front of and aligned with bobbin 12 and to allow controlled motion, back and forth, as thread 26 is loaded on bobbin 12. In combination, thread 26 leaving thread holder 22 is funneled step by step along the way. The thread gate 48 is the large end of the "funnel" directing thread to a certain level by means of horizontal contacts 50. Next vertical contacts 52 aligned one in front of the other, add an "S" curve to the passage of thread 26 to bobbin 12. This, Applicants have found, reduces pull on thread holder 22 and eases entry into thread channel guide 46.

The description of the present embodiments of the invention has been for purposes of illustration, but is not intended to be exhaustive or to limit the invention to the form disclosed. Many modifications and variations will be apparent to those of ordinary skill in the art. As such, while the present invention has been disclosed in connection with an embodiment thereof, it should be understood that other embodiments may fall within the spirit and scope of the invention as defined by the following claims.

What is claimed is:

1. A bobbin loader apparatus comprising:

a. a bobbin connected with a first motor;

b. a thread holder connected with a second motor wherein the thread holder is configured to hold thread;

c. a thread guide connected with a third motor wherein the thread guide directs thread from said thread holder to said bobbin; and d. a motor controller connected with the first motor, the second motor and the third motor wherein the motor controller operates the first motor to turn the bobbin in a first direction and the second motor to turn the thread holder in a second direction such that tension is applied to the thread as thread is added to the bobbin and wherein the motor controller, upon receiving input data including bobbin dimensions and thread dimensions, determines the amount of thread a bobbin will hold.

2. The apparatus of claim 1 wherein the bobbin has a connecting shaft connecting a first end and a second end and wherein the connecting shaft has a length and an outside diameter and the first end and the second end are separated by a width approximately equal to the length of the connecting shaft and wherein the motor controller, upon receiving input data including the width of the bobbin, the length of the connecting shaft, the outside diameter of the connecting shaft and a diameter of a thread to be added to a bobbin, operates the third motor such that the thread guide moves back and forth the length of the connecting shaft such that thread is deposited without overlap.

3. The apparatus of claim 2 wherein the motor controller operates the third motor such that the thread guide moves back and forth the length of the connecting shaft as thread is added to the bobbin.

4. The apparatus of claim 1 wherein the motor controller determines the amount of thread added to a bobbin.

5. The apparatus of claim 1 wherein said thread guide includes a thread channel guide into which thread enters and from which thread exits such that thread is aligned with the thread channel guide as it exits the thread channel guide.

6. The apparatus of claim 5 wherein the thread channel guide is free to move such that as current layers of thread are added to a bobbin, the thread channel guide is aligned with the level of the current layer of thread.

7. The apparatus of claim 1 wherein the thread guide includes a thread gate wherein the thread gate includes a pair of horizontal contacts between which thread from said thread holder is directed.

8. The apparatus of claim 1 further including a pair of vertical contacts between which thread is directed in an "S" pattern.

9. A bobbin loader apparatus comprising:

a. a bobbin removably connected with a first motor, wherein the bobbin has a connecting shaft connecting a first end and a second end and wherein the connecting shaft has a length and an outside diameter and the first end and the second end are separated by a width approximately equal to the length of the connecting shaft;

b. a thread holder connected with a second motor wherein the thread holder is configured to hold thread;

c. a thread guide connected with a third motor wherein the thread guide directs thread from said thread holder to said bobbin; and d. a motor controller connected with the first motor, the second motor and the third motor wherein the motor controller operates the first motor to turn the bobbin in a first direction and the second motor to turn the thread holder in a second direction such that tension is applied to the thread as thread is added to the bobbin and wherein the motor controller operates the third motor such that the thread guide moves back and forth the length of the connecting shaft as thread is added to the bobbin and wherein the motor controller, upon receiving input data including bobbin dimensions and thread dimensions, determines the amount of thread a bobbin will hold.

10. The apparatus of claim 9 wherein the motor controller, upon receiving input data including the width of the bobbin, the length of the connecting shaft, the outside diameter of the connecting shaft and a diameter of a thread to be added to a bobbin, operates the third motor such that the thread guide moves back and forth the length of the connecting shaft such that thread is deposited without overlap.

11. The apparatus of claim 9 wherein the motor controller determines the amount of thread added to a bobbin.

12. The apparatus of claim 9 wherein said thread guide includes a thread channel guide and a thread gate, wherein the thread gate includes a vertical contact and a horizontal contact, into which thread enters and from which thread exits such that thread is aligned with the thread channel guide as it exits the thread gate.

13. The apparatus of claim 12 wherein the thread channel guide is free to move such that as current layers of thread are added to a bobbin, the thread channel guide is aligned with the level of the current layer of thread.

14. The apparatus of claim 9 wherein the thread guide includes a thread gate wherein the thread gate includes a pair of horizontal contacts between which thread from said thread holder is directed.

15. The apparatus of claim 9 wherein the thread guide further includes a pair of vertical contacts between which thread is directed in an "S" pattern.

16. The apparatus of claim 9 wherein the thread guide includes:

a. a thread channel guide into which thread enters and from which thread exits such that thread is aligned with the thread channel guide as it exits the thread channel guide and wherein the thread channel guide is free to move such that as current layers of thread are added to a bobbin, the thread channel guide is aligned with the level of the current layer of thread;

b. a thread gate wherein the thread gate includes a pair of horizontal contacts between which thread from said thread holder is directed; and c. a pair of vertical contacts between which thread is directed in an "S" pattern.

17. A bobbin loader method comprising:

a. providing a bobbin connected with a first motor, wherein the bobbin has a connecting shaft connecting a first end and a second end and wherein the connecting shaft has a length and an outside diameter and the first end and the second end are separated by a width approximately equal to the length of the connecting shaft; a thread holder connected with a second motor wherein the thread holder is configured to hold thread; a thread guide connected with a third motor wherein the thread guide directs thread from said thread holder to said bobbin; and a motor controller connected with the first motor, the second motor and the third motor wherein the motor controller operates the first motor to turn the bobbin in one direction and the second motor to turn the thread holder in a second direction such that tension is applied to the thread as thread is added to the bobbin and wherein the motor controller operates the third motor such that the thread guide moves back and forth the length of the connecting shaft as thread is added to the bobbin and wherein the motor controller, upon receiving input data including bobbin dimensions and thread dimensions, determines the amount of thread a bobbin will hold and wherein the motor controller, upon receiving input data including the width of the bobbin, the length of the connecting shaft, the outside diameter of the connecting shaft and a diameter of a thread to be added to a bobbin, operates the third motor such that the thread guide moves back and forth along the length of the connecting shaft such that thread is deposited without overlap; and b. adding thread to the thread holder, directing thread to the thread guide and from the thread guide to the bobbin.

18. The method of claim 17 wherein the motor controller determines the amount of thread added to a bobbin.

19. The method of claim 17 wherein said thread guide includes a thread channel guide into which thread enters and from which thread exits such that thread is aligned with the thread channel guide as it exits the thread channel guide.

20. The method of claim 19 wherein the thread channel guide is free to move such that as current layers of thread are added to a bobbin, the thread channel guide is aligned with the level of the current layer of thread.

* * * * *